US005173062A

United States Patent [19]

Uchida

[11] Patent Number: 5,173,062

[45] Date of Patent: Dec. 22, 1992

[54] DISCHARGE LAMP CONNECTOR ASSEMBLY

[75] Inventor: Kihachiro Uchida, Shizuoka, Japan

[73] Assignee: Koito Manufacturing Co., Ltd., Tokyo, Japan

[21] Appl. No.: 753,451

[22] Filed: Aug. 30, 1991

[30] Foreign Application Priority Data

Aug. 31, 1990 [JP] Japan ..... 2-228217
Nov. 29, 1990 [JP] Japan ..... 2-325362

[51] Int. Cl.[5] ..... H01R 19/00

[52] U.S. Cl. ..... 439/617; 439/918; 439/686; 439/732

[58] Field of Search ..... 439/611-614, 439/617, 619, 242-244, 682, 686, 689, 229, 239, 918

[56] References Cited

U.S. PATENT DOCUMENTS 4,350,400 9/1982 Gaynor ..... 439/229
4,533,851 8/1985 Block et al. ..... 439/617
4,940,422 7/1990 Forish et al. ..... 439/356
5,059,855 10/1991 Irisawa et al. ..... 439/226

*Primary Examiner*—Neil Abrams
*Assistant Examiner*—Hien D. Vu
*Attorney, Agent, or Firm*—Sughrue, Mion, Zinn, Macpeak & Seas

[57] ABSTRACT

A discharge lamp connector assembly comprises: a male connector having at least two male terminals, the male connector serving as a base of the discharge lamp, the male connector comprising a discharge preventing partition insulator projecting from substantially the center of a region between the male terminals; a female connector engageable with the male connector for securely retaining at least two female terminals which are engageable with the male terminals, the female connector comprising: a housing having spaced partitions which define a comportment for accommodating therein the female terminal, and a holder fitting over the housing by an elastic engagement whereby securely retaining the female terminals, the holder having slits for inserting the male terminals, the holder comprising means engageable with the region between the partitions defining the compartments of the having for receiving the partition insulator of the male connector.

8 Claims, 7 Drawing Sheets

DISCHARGE LAMP CONNECTOR ASSEMBLY

BACKGROUND OF THE INVENTION

1. Field of the Invention

The present invention relates to a discharge lamp connector assembly, more particularly to a connector assembly for discharge lamps that are used as automotive bulbs.

2. Conventional Art

An example of conventional connector assemblies of the type contemplated by the present invention is shown in FIG. 1. The conventional connector assembly comprises a male connector 1 having a pair of projecting male terminals 3 and that serves as the base 2 of a discharge lamp, and a female connector 5 having a pair of female terminals 6 that are capable of engagement with the male terminals 3. Each male terminal 3 is surrounded by a collar 2*a* and a partition 6*a* is formed between the female terminals 6. When the two connectors 1 and 5 are brought into engagement with each other, the male terminals 3 engage with the female terminals 5. At the same time, the partition 6*a* engages with the gap 2*b* between the collars 2*a* so that the creepage distance between the positive and negative terminals will increase to provide enhanced insulation.

In the conventional connector assembly described above, the basal end of each female terminal 6 is secured to the female connector housing by means of a nut 7. This structure would cause a problem in that it is cumbersome to secure the female terminals 6 to the connector housing, which eventually makes the assembling of the female connector a time-consuming operation.

SUMMARY OF THE INVENTION

The present invention has been accomplished under these circumstances and an object of the invention is to provide a discharge lamp connector assembly that insures effective insulation between terminals and that enables the female connector to be assembled in an easy way.

Another object of the invention is to provide a discharge lamp connector assembly with which any foreign matter such as water or dust will not get into the female terminal accommodating compartments, thereby insuring positive insulation of the female terminals from the outside of the female connector.

The above and other objects of the present invention can be achieved by a provision of a discharge lamp connector assembly which comprises a male connector that is provided with a pair of projecting male terminals and that serves as the base of discharge lamp and a female connector that securely retains a pair of female terminals capable of engagement with said pair of male terminals and that is capable of engagement with said male connector, which connector assembly is characterized in that: the male connector has a discharge preventing partition insulator that projects generally from the center of the region between the male terminals in such a way that it traverses the inter-terminal region; said female connector comprises a female connector housing that has a pair of spaced partitions each of which defines a terminal accommodating compartment in its exterior, female terminals that are respectively accommodated within the compartments, and a female terminal holder that is fitting over said female connector housing by elastic engagement to securely retain the female terminals and that has holes through which the male terminals can be inserted; and the femal terminals holder has a hollow engaging portion that engages with the region between the partitions which define the terminal accommodating compartments and that is capable of engagement with the partition insulator of the male connector.

The hollow engaging portion of the female terminal holder engages with the region between the partitions of the female connector which define the terminal accommodating compartments and, at the same time, the discharge preventing partition insulator of the male connector engages with the recess formed on the front side of the hollow engaging portion of the female terminal holder, whereby the air clearance and creepage distance between the positive and negative terminals are increased to provide enhanced insulation between those terminals.

The female terminals are then put into the respective terminal accommodating compartments of the female connector housing and the female terminal holder is fitted over the female connector housing by elastic engagement. As a result, the female terminal holder allows the female terminals to be securely retained within the connector housing, thereby providing an integral female connector.

Further, the female connector housing is enclosed with the female terminal holder to provide an integral unit so that any foreign matter such as water or dust will not get into the female terminal accommodating compartments, thereby insuring positive insulation of the female terminals from the outside of the female connector.

DESCRIPTION OF THE PREFERRED EMBODIMENTS

The preferred embodiments of the present invention will now be described in detail with reference to accompanying drawings.

A first embodiment of the present invention is described below with reference to FIGS. 2-5.

Figure 1:
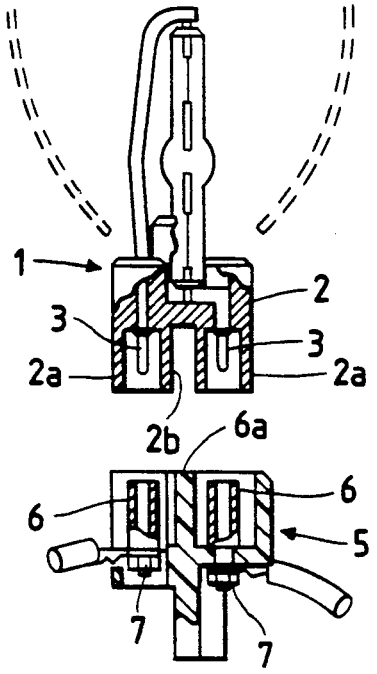
FIG. 1 PRIOR ART
FIG. 1 is a sectional view of the conventional connector assembly.
Figure 5:
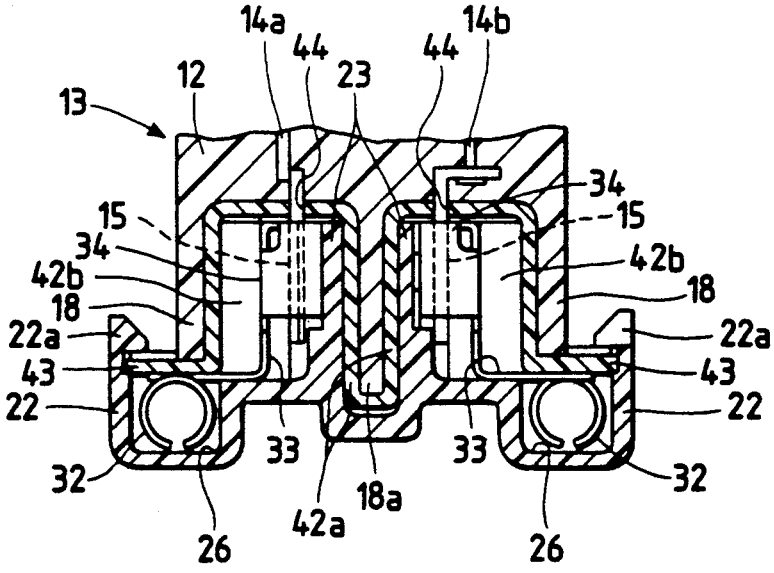
FIG. 5 is a longitudinal section of the female connector as it is coupled to the male connector.
Figure 2:
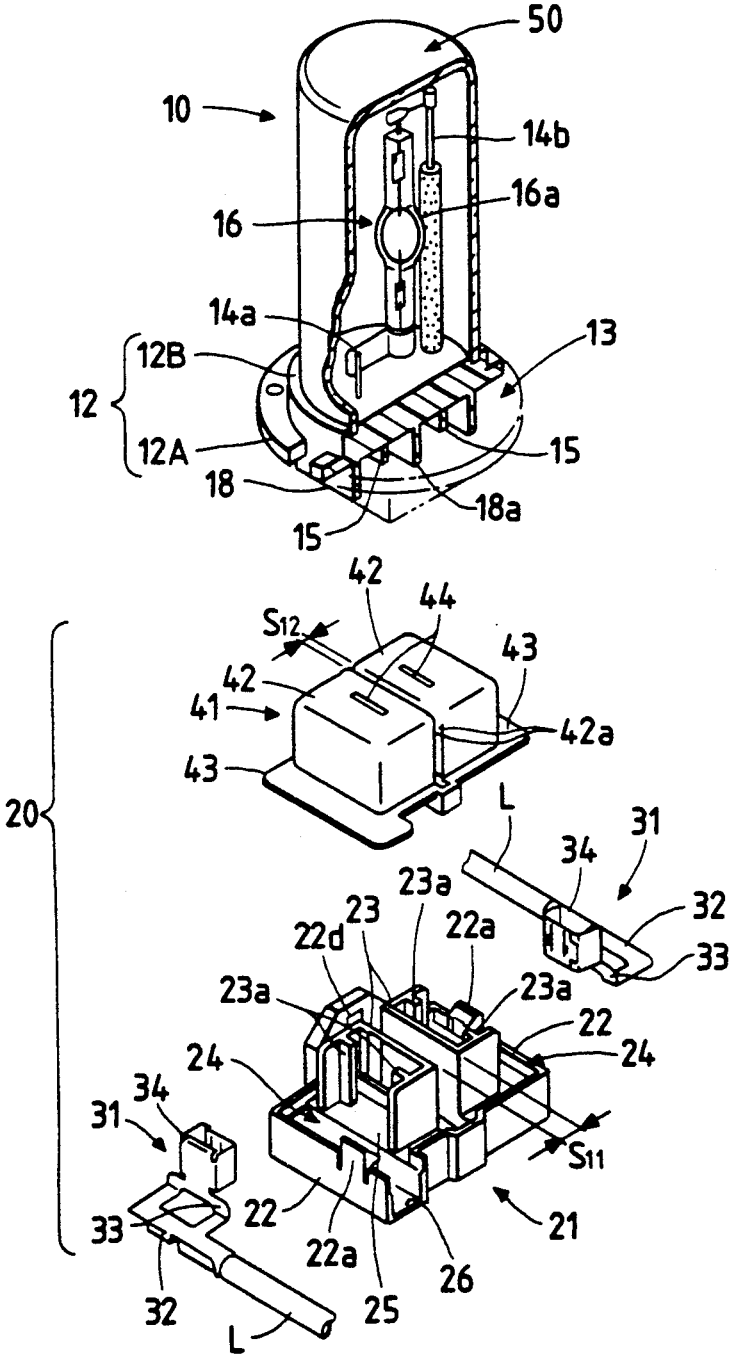
FIG. 2 is a perspective view showing a discharge lamp connector assembly according to an embodiment of the present invention in an unassembled state.
Figure 3:
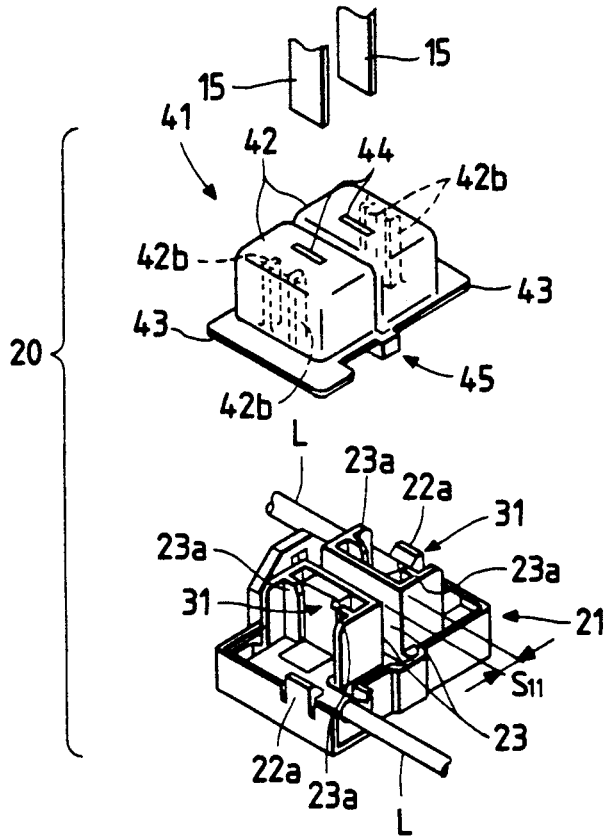
FIG. 3 is a perspective view of the same connector assembly in an unassembled state, except that the female terminals are accommodated in the female connector housing.
Figure 4:
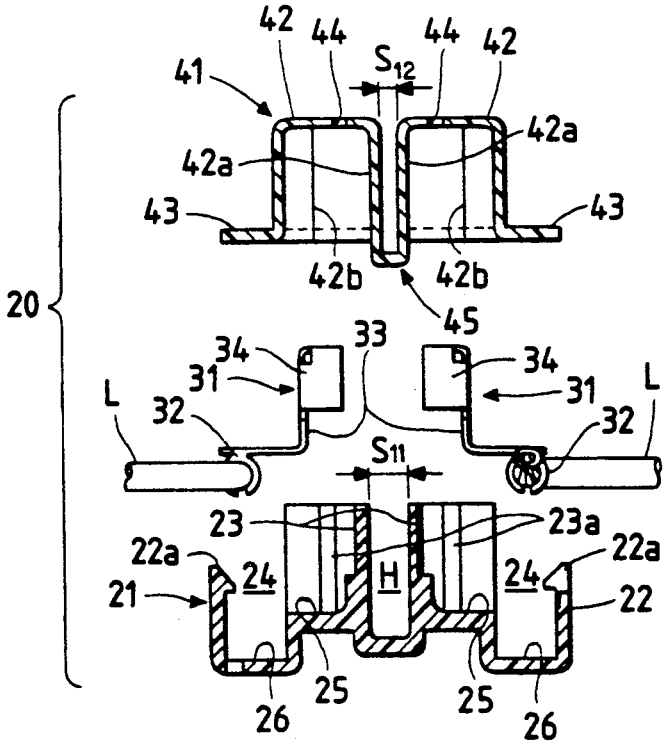
FIG. 4 is a longitudinal section of the female terminal connector in an unassembled state.

FIG. 2 is a perspective view showing a discharge lamp connector assembly of the invention in an unassembled state; FIG. 3 is a perspective view of the same connector assembly in an unassembled state, except that the female terminals are accommodated in the female connector housing; FIG. 4 is a longitudinal section of the female connector in an unassembled state; and FIG. 5 is a longitudinal section of the female connector as it is coupled to the male connector.

In those figures, reference numeral 10 denotes a discharge lamp to be used as an automotive headlamp. The light-emitting part 16 of the lamp is supported by a pair of lead supports 14*a* and 14*b*, the lead support 14*a* being shorter than the lead support 14*b*, that project toward the front side of an insulating lamp base 12 that is made of a synthetic region. A UV shielding globe 50 is fixed at its open basal end to the front side of the base 12 by means of an adhesive in such a way that the light-emitting part 16 of the discharge lamp is enclosed with the cup-shaped globe 50 so that any UV radiation that is emitted from the discharging part 16*a* will be blocked by said globe 50. Male terminals 15 that are welded or otherwise rendered integral with the lead supports 14*a* and 14*b* project from the rear side of the base 12 to form a male connector 13 that is integral with the rear end of the base 12. An insulating partition 18 is formed on the periphery of the base 12 in such a way that it surrounds the male terminals 15, and a discharge preventing partition insulator 18*a* is also between the male terminals 15 in such a way that it lies across the partition 18.

A female connector 20 that comprises a connector housing 21 shaped as a container that is made of a synthetic resin and that has a pair of terminal accommodating compartments 24 formed therein, female terminals 31 that are accommodated in those compartments 24, and a female terminal holder 41 that is made of a synthetic resin and that securely retains the female terminals 31 within the respective compartments 24.

The front face of the connector housing 21 is provided with a pair of projecting partitions 23 that are spaced apart by a predetermined distance $S_{11}$ and the terminal accommodating compartment 24 having a step 25 is formed between each of the partitions 23 and the peripheral wall 22 of the housing. Shown by 23*a* are vertical ribs that extend parallel to each partition 23 and that support the right and left sides of the terminal 31 accommodated in each compartment 24.

Each of the female terminals 31 is formed by bending a thin metal sheet cut to a predetermined shape and it is a unitary assembly of a cord connecting region 32 having a generally U-shaped cross section that extends to both right and left, and extension region 33 having a generally L-shaped cross section that is continuous to the cord connecting region 32 and that rises therefrom in an upward direction, and a terminal region 34 that is formed at the upper end of the extension region and that is shaped like a rectangular box to permit engagement with each male terminal 15. Each female terminal 31 is accommodated in the connector hosing in the following manner: the terminal region 34 is placed parallel to the outer surface of the partition 23 which defines the associated terminal accommodating compartment, with the right and left sides of the terminal region 34 being brought into contact with the vertical ribs 23*a*; and the cord connecting region 32 is accommodated in a cord insertion channel 26 that extends outward from the associated terminal accommodating compartment. Since the extension region 33 of the female terminal 31 is bent to have a generally L-shaped cross section, the overall length of each terminal is shortened in the direction in which the male and female connectors are coupled or decoupled (the vertical direction as viewed in FIG. 4) so that the female connector 20 is accordingly made compact.

The female terminal holder 41 is molded as an integral unit in which a pair of regions 42 shaped as a rectangular vessel that correspond to the terminal accommodating compartments 24 are spaced apart by a predetermined distance $S_2$. The longitudinal side edge 43 of the holder serves to prevent slippage by engaging with hooks 22*a* that are formed on the peripheral wall 22 of the female connector. The regions 42 are so shaped that they cover completely the respective female terminals 31 from above, thereby to insure positive insulation between those terminals. The opposite side walls 42*a* of the regions 42 define a hollow partition 45 (see FIGS. 3 and 4), so that those side walls 42*a* will just come into engagement with the recess H between the partitions 23 when the terminal holder 41 is fitted over the connector housing 21. A pair of vertical ribs 42*b* are formed in each region 42 in such a way that they will contact and retain the terminal region 34 of each female terminal as the latter is accommodated in the compartment 24. The regions 42 are of such a size that they just come into engagement with the inside surfaces of the partitions 18 of the male connector 13. A hole 44 through which the male terminal is to be inserted is formed in the upper end of each region 42 of the terminal holder 41. When the terminal holder 41 is fitted over the female connector housing 21, the female terminals 31 are securely retained within the respective terminal accommodating compartments 24; thereafter, the two connectors 13 and 20 are brought into mutual engagement for coupling, whereupon the male terminals 15 that project through the holes 44 into the compartments 24 are inserted into the terminal regions 34 of the associated female terminals. The gap $S_{12}$ between the regions 42 is of such dimensions that they will engage with the partition insulator 18*a* of the male connector 13, so that said insulator will be completely fitted into the gap $S_{12}$ when the two connectors 13 and 20 are coupled together.

We now describe the procedures of assembling the female connector 20 and coupling it to the male connector 13.

As shown in FIG. 3, the female terminals 31 each connected to a power supply lead wire L are placed into the respective terminal accommodating compartments 24 of the female connector housing 21. The female terminal holder 41 is press-fitted over the housing 21 from above in counteraction against the resilience of the hooks 22*a*, whereby the holder 41 is brought into elastic engagement with the housing 21. As a result, the hollow partition 45 of the holder 41 is brought into engagement with the recess H between partitions 23 of the female connector housing 21 and, at the same time, the vertical ribs 42*b* on the terminal holder 41 support the female terminals 31, whereby the female terminals 31 are securely retained within the compartments 24 to provide an integral female connector 20. Subsequently, this female connector 20 is coupled to the male connector 13 on the discharge lamp 10 mounted into a reflector (not shown) through a bulb mounting hole (also not shown). Coupling of the two connectors 13 and 20 may be achieved by inserting the male terminals 15 through holes 44. In this why, male connector hooks (not shown) formed on the outer surface of the partition insulator 18 come into engagement with engaging recesses 22*d* (see FIG. 2) that are formed in the female connector housing 21 of the female connector 20, whereby the two connector are protected against slippage.

The male connector 13 as it is coupled to the female connector 20 is shown in FIGS. 4 and 5, within the partition insulator 18*a* of the male connector 13 being fitted into the gap $S_{12}$ in the female terminal holder 41. The opposite side walls 42*a* of the terminal holder that are made of a synthetic resin and which are a better insulator than an air layer as well as the partition insulator 18*a* that is also made of a synthetic resin extend between the terminals 15 (as well as 31). Further, the air clearance and creepage distance between opposing terminals 15 (as well as 31) are increased by an amount that is generally equal to the length of projection of the partition insulator 18*a*, which contributes enhanced insulation between the positive and negative terminals.

A second embodiment of the present invention is described below with reference to FIGS. 6–11.

Figure 6:
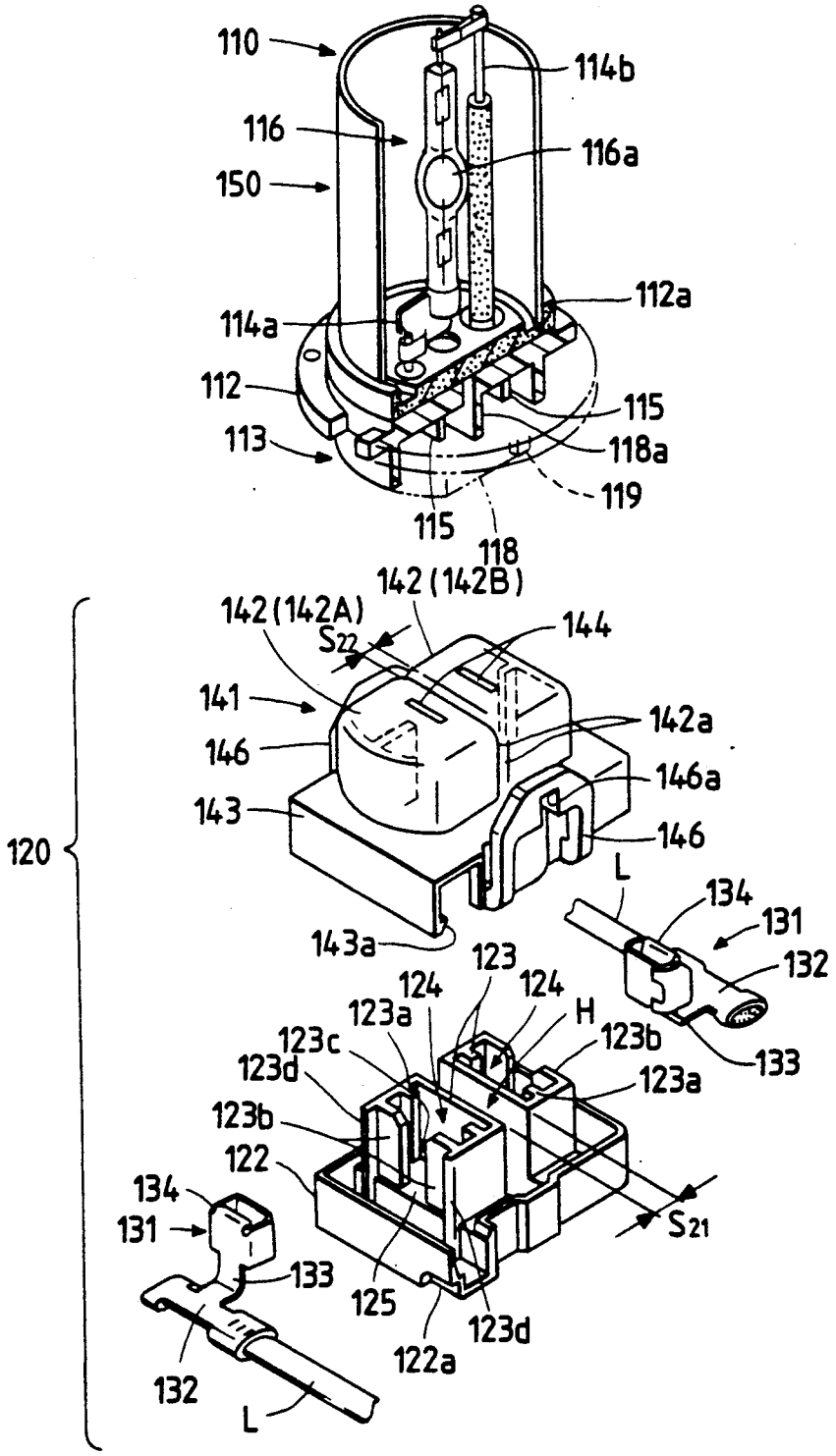
FIG. 6 is a perspective view showing a discharge lamp connector assembly according to a second embodiment of the present invention in an unassembled state.
Figure 7:
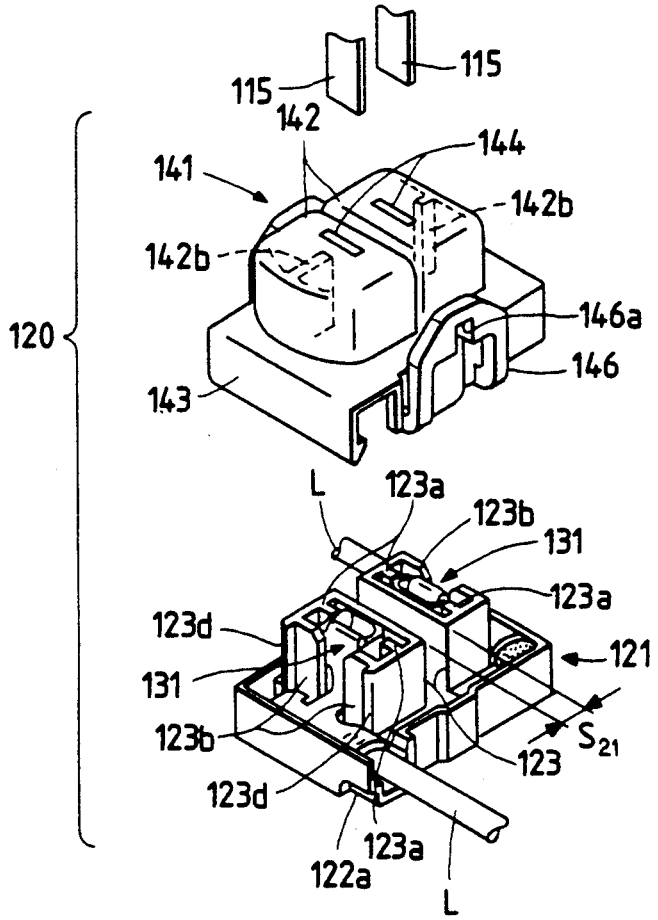
FIG. 7 is a perspective view of the same connector assembly in an unassembled state, except that the female terminals are accommodated in the female connector housing.
Figure 8:
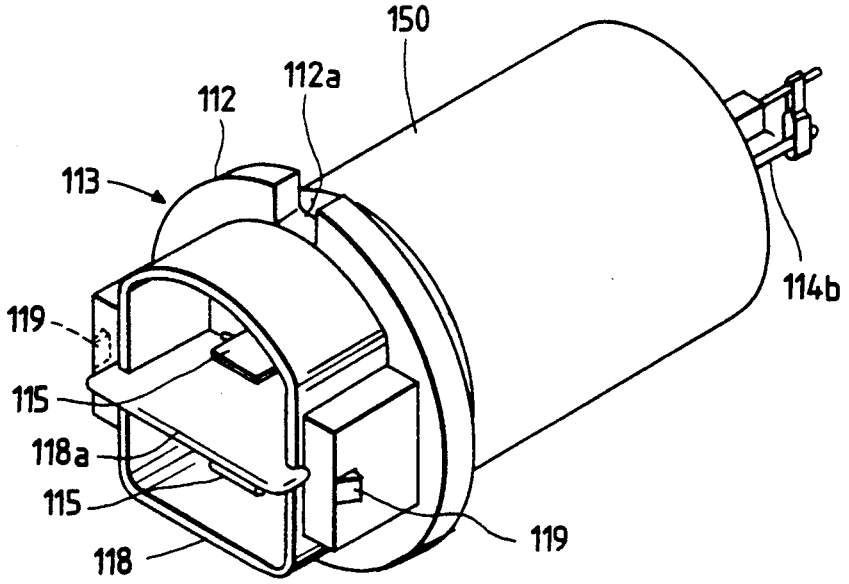
FIG. 8 is a perspective view of a discharge lamp as viewed from its back side.
Figure 9:
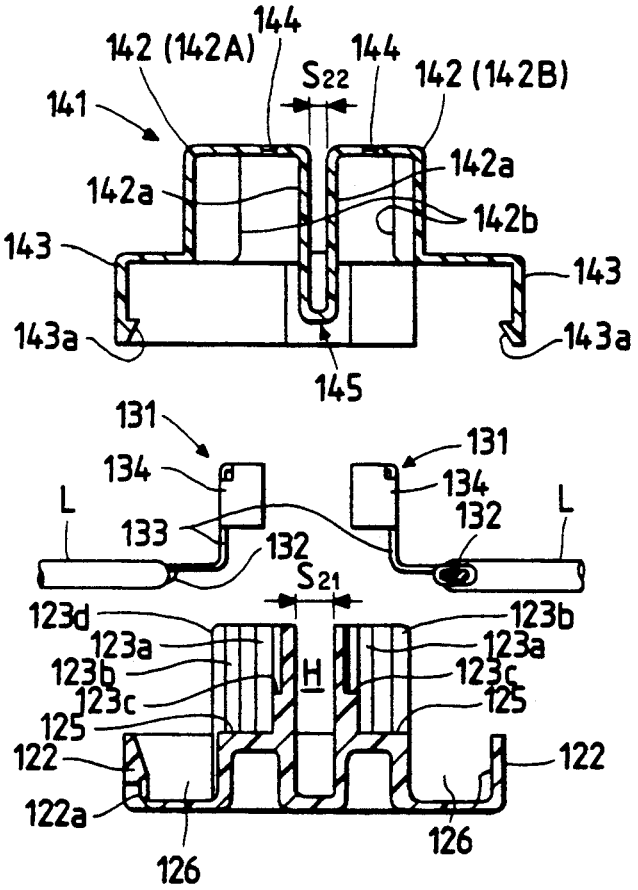
FIG. 9 is a longitudinal section of the female terminal connector in an unassembled state.
Figure 10:
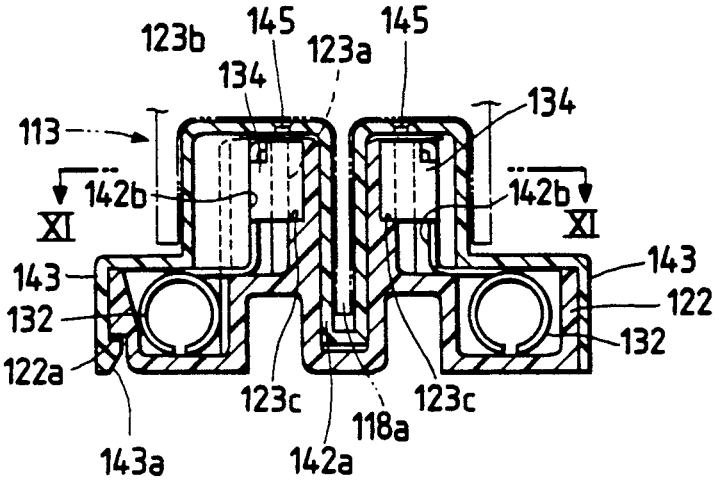
FIG. 10 is a longitudinal section of the female connector as it is coupled to the male connector.
Figure 11:
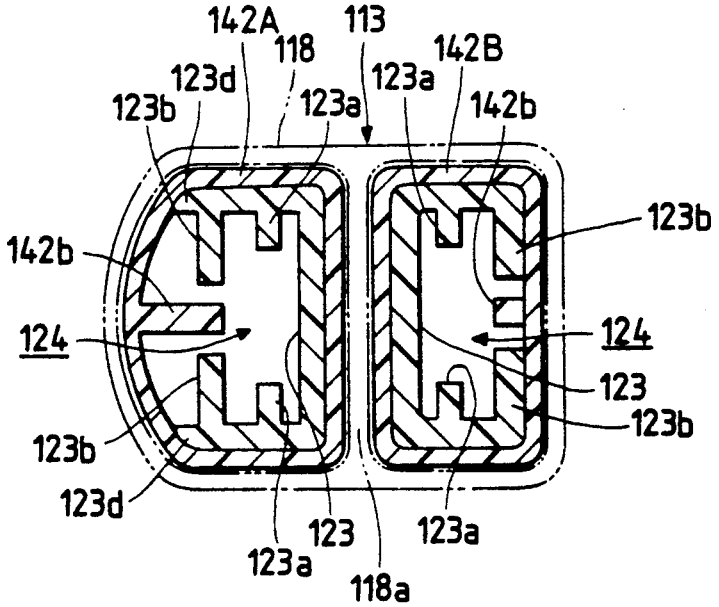
FIG. 11 is a cross section of FIG. 10 as taken on line XI—XI, with the female terminals omitted.

FIG. 6 is a perspective view showing a discharge lamp connector assembly according to the second embodiment of the invention in an unassembled state; FIG. 7 is a perspective view of the same connector assembly in an unassembled state, except that the female terminals are accommodated in the female connector housing; FIG. 8 is a perspective view of a discharge lamp as viewed from its back side; FIG. 9 is a longitudinal section of the female connector in an unassembled state; FIG. 10 is a longitudinal section of the female connector as it is coupled to the male connector; and FIG. 11 is a cross section of FIG. 10 as taken on line XI—XI, with the female terminals omitted.

In those figures, numeral 110 denotes a discharge lamp to be used as an automotive headlamp. The light-emitting part 116 of the lamp is supported by a pair of lead supports 114*a* and 114*b*, the lead support 114*a* being shorter than the lead support 114*b*, that project toward the front side of the an insulating lamp base 112 that is made of a synthetic resin. A ceramic disk 112*a* is formed as an integral part of the front side of the base 112. A cylindrical UV shielding globe 150 is fixed at its basal end to the disk 112*a* by means of an adhesive in such a way that the light-emitting part 116 of the discharge lamp is enclosed with the cup-shaped globe 150 so that any UV radiation that is emitted from the discharging part 116*a* will be blocked by said globe 150. A tubular partition 118 that projects backward is formed as an integral part of the rear side of the base 112. Male terminals 115 that are welded or otherwise connected electrically to the lead supports 114*a* and 114*b* project into the partition 118 so as to form a male connector 113 that is integral with the rear end of the insulating lamp base 112. One lateral side of the partition 118 takes on a circular arc shape that is different from the other sides. The part of a female connector to be described later in this specification that engages the partition 118 also assumes the same shape as said lateral side to insure that when the male connector 113 is coupled to the female connector, positive and negative terminals are correctly connected, with either being connected to the ground for lighting on an ac power source. A discharge preventing partition insulator 118*a* is also provided in such a way that it traverses the area between the male terminals 115. The outer surface of the tubular partition 118 is provided with a pair of projecting hooks 119 that serve as the mating member of the elastic engaging portion of the female connector which is to be described later in this specification.

Shown by 120 is a female connector that comprises a connector housing 121 shaped as a container that is made of a synthetic resin and that has a pair of terminal accommodating compartments 124 formed therein, female terminals 131 that are accommodated in those compartments 124, and a female terminal holder 141 that is made of a synthetic resin and that securely retains the female terminals 131 within the respective compartments 124.

The front face of the connector housing 121 is provided with a pair of projecting partitions 123 that are spaced apart by a predetermined distance $S_{21}$ and the terminal accommodating compartment 124 having a step 124 is formed between each of the partitions 123 and the peripheral wall 122 of the housing. Shown by 123*a* and 123*b* are vertical ribs that extend parallel to each partition 123. Vertical ribs 123*a* support the right and left sides of the terminal 131 accommodated in each compartment 124, whereas vertical ribs 123*b* engage with the constricted portion of each female terminal 131 to prevent its slippage. Shown by 123*c a*are horizontal ribs that determine the vertical position of female terminals 131. Shown by 123*d* are vertical ribs that are formed on one of the partitions that define the compartments 124 and they help eliminate the possibility of erroneous installation of the female terminal holder 141.

Each of the female terminals 131 is formed by bending a thin metal sheet cut to a predetermined shape and it is a unitary assembly of a cord connecting region 132 having a generally U-shaped cross section that extends to both right and left, an extension region 133 of narrow width having a generally L-shaped in cross section that is continuous to the cord connecting region 132 and that rises therefrom in an upward direction, and a terminal region 134 that is formed at the upper end of the extension region and that is shaped like a rectangular box to permit engagement with each male terminal 115. Each female terminal 131 is accommodated in the connector housing 121 in the following manner: the terminal region 134 is placed in the terminal accommodating portion defined by the partition 123 and vertical ribs 123*b* and, subsequently, the cord connecting region 132 is accommodate in a cord insertion channel 126 that extends outward from the associated terminal accommodating compartment 124. In this case, the terminal region 134 is located with its four horizontal positions being properly determined by vertical ribs 123*a* and 123*b*.

The female terminal holder 141 is molded as an integral unit in which a pair of regions 142 (142A and 142B) shaped like a rectangular vessel that correspond to the terminal accommodating compartments 124 are spaced apart by a predetermined distance $S_{22}$. The terminal holder 141 also has as an integral part a peripheral wall 122 of the housing. The skirting peripheral wall 143 has hooks 143*a* that serve to prevent slippage by engaging with recesses 122*a* formed in the peripheral wall 122 of the housing. The opposite side walls 142*a* of the regions 142 define a hollow partition 145 (see FIGS. 7 and 9), so that those side walls 142*a* will just come into engagement with the recess H between the partitions 123 when the terminal holder 141 is fitted over the connector housing 121. A pair of vertical ribs 142*b* are formed in each region 142 in such a way that they will contact and retain a lateral side of the terminal region 134 and the top of the extension region 133 of each female terminal as the latter is accommodated in the compartment 124. The terminal region 134 is surrounded by the partition 123 and further covered with the region 142 in a rectangular vessel form that has as the sole opening a hole 144 through which to pass a female terminal. The peripheral wall 122 of the connector housing 121 is enclosed with the skirting outer wall 143 of the terminal holder 141, whereby the interior of the connector housing 121 is effectively protected against the entrance of water, dust and other foreign matter to insure positive insulation of female terminals 131 not only between themselves but also from the outside of the housing.

The regions 142 are of such a size that they just come into engagement with the inside surfaces of the partition 118 of the male connector 113. A pair of projecting arched gates 146 are formed on the skirting peripheral wall 143 and each gate has a recess 146*a* that is to engage with the associated hook 119 on the male connector 113 to prevent its slippage. The hole 144 through which the male terminal is to be inserted is formed in the upper end of each region 142 of the terminal holder 141. When the terminal holder 141 is fitted over the female connector housing 121 to provide an integral unit, the female terminals 131 are securely retained vertically within the respective terminal accommodating compartments 124; thereafter, the two connectors 113 and 120 are brought into mutual engagement for coupling, whereupon the male terminals 115 that project vertically through the holes 144 into the compartments 124 are inserted into the terminal regions 134 of the associated female terminals. When the two connectors 113 and 120 are to be coupled together, proper engagement can be achieved only when the circular arc portion of the partition 118 of the male connector fits the corresponding circular arc portion of the female connector, and this totally eliminates the possibility of erroneously connecting the positive and negative terminals of the two connectors. The gap $S_{22}$ shown in FIG. 6 between the regions 142 is of such dimensions that they will engage with the partition insulator 118*a* of the male connector 113, so that said insulator will be completely fitted into the gap $S_{22}$ when the two connectors 113 and 120 are coupled together.

We now describe the procedures of assembling the female connector 120 and coupling it to the male connector 113.

As shown in FIG. 7, the female terminals 131 each connected to a power supply lead wire L are placed into the respective terminal accommodating compartments 124 of the female connector housing 121. The female terminal holder 141 is press-fitted over the housing 121 from above, so that the holder 141 is brought into elastic engagement with the housing 121. As a result, the hollow partition 145 of the holder 141 is brought into engagement with the recess H between partitions 123 of the female connector housing 121 and, at the same time, the vertical ribs 142*b* on the terminal holder 141 abut against the female terminals 131, whereby the female terminals 131 are tightly retained within the compartments 124 to provide an integral female connector 120. Subsequently, this female connector 120 is coupled to the male connector 113 on the discharge lamp 110 mounted into a reflector (not shown) through a bulb mounting hole (also not shown). Coupling of the two connectors 113 and 120 may be achieved by positioning the female connector 120 in the male terminals 115 are inserted through holes 144. In this way, such a way that hooks 119 formed on the outer surface of the partition insulator 118 come into engagement with engaging recesses 146*a* that are formed in the female terminal holder 141 of the female connector 120, whereby the two connectors are protected against slippage.

The male connector 113 as it is coupled to the female connector 120 is shown in FIG. 10, with the partition insulator 118*a* of the male connector 113 being fitted into the gap $S_{22}$ in the female terminal holder 141. The opposite side walls 142*a* of the terminal holder that are made of a synthetic resin and which are a better insulator than an air layer as well as the partition insulator 118*a* that is also made of a synthetic resin extend between the terminals 115 (as well as 131). Further, the air clearance and creepage distance between opposing terminals 115 (as well as 131) are increased by an amount that is generally equal to the length of projection of the partition insulator 118*a*, which contributes enhanced insulation between the positive and negative terminals.

As will be apparent from the foregoing description, the discharge lamp connector assembly of the present invention is such that the hollow engaging portion of the female terminal holder engages with the region between the partitions of the female connector which define the terminal accommodating compartments while, at the same time, the discharge preventing partition insulator of the male connector engages with the recess formed on the front side of the hollow engaging portion of the female terminal holder, whereby the air clearance and creepage distance between the positive and negative terminals are increased to provide enhanced insulation between those terminals.

Further, the female connector housing is enclosed with the female terminal holder to provide an integral unit so that any foreign matter such as water o dust will not get into the female terminal accommodating compartments, thereby insuring positive insulation of the female terminals from the outside of the female connector.

The female terminals are then put into the respective terminal accommodating compartments of the female connector housing and the female terminal holder is fitted over the female connector housing by elastic engagement. As a result, the female terminal connector allows the female terminals to be securely retained within the connector housing, thereby providing an integral female connector. This helps facilitate the operation of assembling the female connector and, therefore, coupling it to the male connector.

What is claimed is:

1. A discharge lamp connector assembly, comprising:

a male connector having at least two male terminals, said male connector serving as a base of the discharge lamp, said male connector comprising a discharge preventing partition insulator projecting from substantially the center of a region between said male terminals;

a female connector engageable with said male connector for securely retaining at least two female terminals which are engageable with said male terminals, said female connector comprising:

a housing having spaced partitions which define compartments for repectively accommadating therein said female terminals, said partitions defining a space therebetween, and a holder fitting over said housing by an elastic engagement thereby securely retaining said female terminals, said holder having slits for inserting said male terminals, said holder comprising means, engageable with the space between said partitions and said female terminals, for receiving therein said partition insulator of said male connector.

2. The discharge lamp connector assembly of claim 1, wherein said holder of said female connector substantially covers said housing thereby producing an integral unit of said female connector.

3. The discharge lamp connector assembly of claim 2, wherein said holder of said female connector comprises means for elastically engaging with said male connector.

4. The discharge lamp connector assembly of claim 1, wherein said receiving means of said holder includes a hollow member which is insertable into said space between said partitions.

5. The discharge lamp connector assembly of claim 4, wherein said partition insulator of said male connector is insertable into said hollow member.

6. A discharge lamp connector assembly, comprising:

a male connector having at least two male terminals, said male connector serving as a base of the discharge lamp and including a discharge preventing partition insulator projecting from substantially the center of a region between said male terminals; and a female connector engageable with said male connector for securely retaining at least two female terminals which are engageable with said male terminals, said female connector including:

a housing having spaced partitions which define compartments for respectively accommodating therein said female terminals, and a holder fittable over said housing and including means, disposed in said space between said female connectors, for electrically insulating said female terminals from one another.

7. The discharge lamp connector assembly of claim 6, wherein said insulating means includes for securing said holding to said housing.

8. A discharge lamp connector assembly of claim 7, wherein said insulating means includes a hollow member extending from said holder and being insertable into said space defined by said partitions, and wherein said partition insulator is insertable into said hollow member.

* * * * *